US005123784A

United States Patent [19]

Takahei

[11] Patent Number: 5,123,784

[45] Date of Patent: Jun. 23, 1992

[54] METHOD OF SEALING CONSTRUCTION JOINT IN TOP-DOWN CONSTRUCTION METHOD

[75] Inventor: Yoshifumi Takahei, Osaka, Japan

[73] Assignee: Takenaka Corporation, Osaka, Japan

[21] Appl. No.: 611,324

[22] Filed: Nov. 9, 1990

Related U.S. Application Data

[63] Continuation of Ser. No. 342,482, Apr. 24, 1989, abandoned.

[30] Foreign Application Priority Data

Apr. 28, 1988 [JP] Japan ..... 63-108512

[51] Int. Cl.[5] ..... B28B 1/16; B28B 7/34; E02D 29/00; E04B 1/16

[52] U.S. Cl. ..... 405/267; 52/700; 52/744; 249/10; 249/61; 249/98; 249/99; 249/101; 249/183; 264/34; 264/35; 264/256; 264/261; 264/263; 264/264; 264/275; 264/277; 264/279; 264/279.1; 264/308; 264/313; 264/317; 264/333; 264/334; 264/337

[58] Field of Search ..... 264/31-35, 264/333, 256, 261, 317, 263, 264, 271.1, 275, 277, 279, 308, 279.1, 313, 334, 337; 249/98, 99, 101, 61, 10, 183; 52/700, 744; 405/267

[56] References Cited

U.S. PATENT DOCUMENTS

| | | | |
|---|---|---|---|
| 784,926 | 3/1905 | Crawford | 52/744 |
| 2,239,989 | 4/1941 | Britton | 249/10 |
| 2,341,518 | 2/1944 | Allin | 52/744 |
| 2,644,997 | 7/1953 | Billings | 249/99 |
| 2,798,373 | 7/1957 | Harza | 249/98 |
| 3,166,815 | 1/1965 | Rappas | 249/9 |
| 3,186,676 | 6/1985 | Crone | 249/9 |
| 3,204,316 | 9/1965 | Jackson | 264/334 X |
| 3,239,587 | 3/1966 | Dietziker | 264/35 |
| 3,297,294 | 1/1967 | Middlestadt | 249/61 |
| 3,464,665 | 9/1969 | Schoewert | 249/10 |
| 3,589,664 | 6/1971 | Middlestadt | 249/9 |
| 4,509,884 | 4/1985 | Trout et al. | 52/744 X |
| 4,798,502 | 1/1989 | Trout | 52/744 X |

*Primary Examiner*—Karen Aftergut
*Attorney, Agent, or Firm*—Price, Gess & Ubell

[57] ABSTRACT

A method of sealing a concrete joint formed between a pair of concrete castings by creating an injection hole wherein a removable frame member can be attached to the bottom surface of the first concrete casting so as to form obtuse angles with the concrete casting surface. The other concrete casting is then cast around the frame member. The frame member is then removed to form the injection hole of the desired configuration, and sealing material can then be inserted into the injection hole for feeding into, and sealing of, the joint.

7 Claims, 6 Drawing Sheets

PRIOR ART

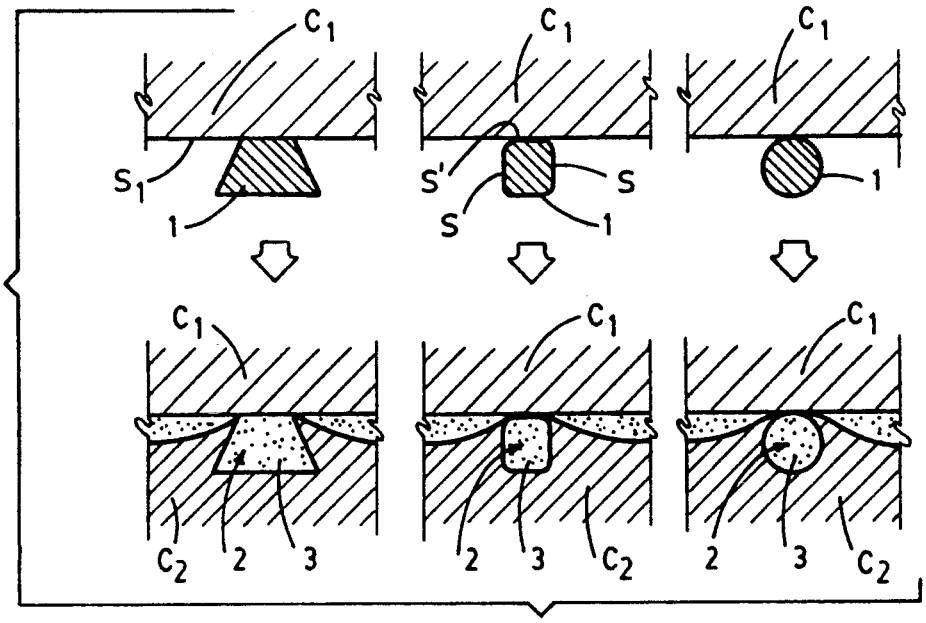
PRIOR ART FIG. 13
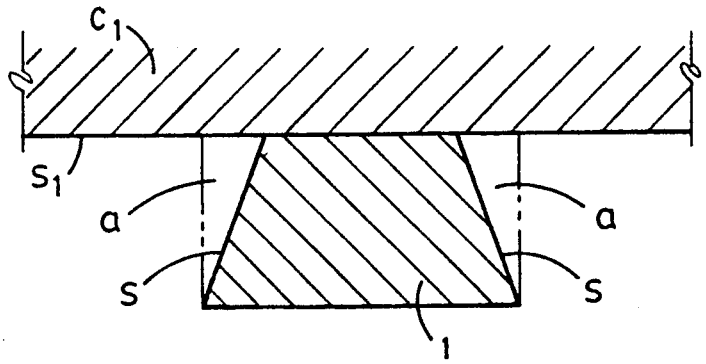
PRIOR ART FIG.14
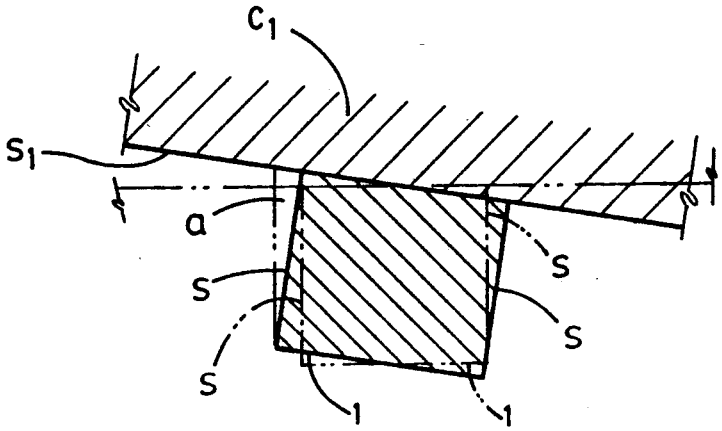
PRIOR ART FIG.15

METHOD OF SEALING CONSTRUCTION JOINT IN TOP-DOWN CONSTRUCTION METHOD

This is a continuation of application Ser. No. 342,482, filed on Apr. 24, 1989, now abandoned, for a METHOD OF TREATING CONSTRUCTION JOINT IN TOP-DOWN CONSTRUCTION METHOD.

DETAILED DESCRIPTION OF THE INVENTION

The present invention relates to a method of treating construction joints in a top-down construction method in which an injection hole is intentionally formed in a minute clearance which is produced in vertical construction joints of concrete pillars, walls and the like in the case where the up-down construction method is applied to the underground construction of buildings (a clearance produced between an upper concrete and a lower concrete, which is constructed below the upper concrete, due to the sinking of a surface of the lower concrete by the rise of a bleeding water) and an injection material, such as cement paste containing expansive additive and non-shrinkage additive, is injected through said injection hole to integrally construct the upper and lower concretes.

BRIEF DESCRIPTION OF THE PRIOR ART

Frequently some clearance is produced between an upper concrete and a lower concrete due to the sinking of a surface of the lower concrete by the rise of a bleeding water in vertical construction joints created by top-down concreting but also a laitance is accumulated in an upper portion of the clearance however carefully the lower concrete may be constructed.

Accordingly, it has been necessary that the above described construction joints be subjected to some treatments to fill up the above described clearance, whereby the upper and lower concretes are integrated.

One of these treatment methods is a so-called "injection method".

This "injection method" includes: a method, in which the lower concrete $C_2$ is constructed and then the injection hole 2 is formed from the direction crossing the construction joints by means of a drill, as shown in FIG. 10(A); a method, in which the injection hole 2 is formed along the construction joints by means of a drill and the injection materials, such as cement paste containing expansive additive, epoxy resin and isocyanate resin, are injected through said injection hole 2, as shown in FIG. 10(B); and a method, in which an injection groove 8 opening downward is previously formed in the bottom surface $S_1$ of the upper concrete $C_1$ and the lower concrete $C_2$ is constructed and followed by injecting the similar injection materials 3 through said injection groove 8, as shown in FIG. 11.

However, in the above described methods, in which the injection hole 2 is formed by the use of a drill, steel frames and the like exist within the construction joints, so that a deep hole can not be drilled, and as a result, the injection is conducted merely in portions close to the surface, whereby the injection can not be achieved up to surroundings of the internal steel frames according to the particular circumstances.

In addition, in the method in which the injection groove 8 is previously formed, the injection groove 8 is stopped up by constructing the lower concrete $C_2$, whereby the injection is impossible or incomplete in many cases.

The present inventor has proposed an "injection method" capable of eliminating the above described disadvantages in Japanese Patent Publication No. Sho 58-5346 (Japanese Patent No. 117639).

This is a method of treating construction joints, in which a lower concrete $C_2$ is constructed below an upper concrete $C_1$ under the condition that a framework 1 for forming an injection hole is mounted on a bottom surface $S_1$ of said upper concrete $C_1$, as shown in FIG. 12(A) to (D), and after the lower concrete $C_2$ is set, said framework 1 is taken off to form the injection hole 2 followed by injecting the injection materials 3, such as cement paste containing expansive additive, through said injection hole 2. Referring to FIG. 12, reference numeral 4 designates a framework for the lower concrete.

In addition, a measure for taking off the framework 1 for forming an injection hole includes a method, in which said framework 1 is pulled out, and a method, in which said framework 1 is dissolved in solvents.

The present inventor has conducted many experiments aimed at the practical use and the still further improvement in reliability of the method of treating construction joints in the up-down construction method proposed in Japanese Patent Publication No. Sho 58-5346 and found from the results of these experiments that the following problems occur according to a longitudinal sectional shape of the framework 1 for forming an injection hole in the above described method.

That is to say, in the case where the longitudinal section of the framework 1 for forming an injection hole has a circular shape, a shape with rounded corners on right and left side surfaces S and the upper surface S' or a trapezoidal shape, as shown in FIG. 13, even though the lower concrete $C_2$ is set followed by taking off (pulling off or dissolving) the framework 1 to accurately form the injection hole 2, the injection material 3 has been incompletely injected. The reason for this is that when a surface $S_2$ of the lower concrete $C_2$ is settled with the rise of bleeding water, the settlement of concrete portions positioned above the right and left side surfaces S of the framework 1 (portions designated by marks (a), (a) in FIG. 14,) is hindered by said side surfaces S, whereby said concrete portions (a), (a) are set under the condition that they are brought into close contact with or close to the bottom surface $S_1$ of the upper concrete $C_1$, and as a result, the continuity of the injection hole 2 and the clearance in the construction joint is deteriorated, whereby the injection material 3 can not be injected into the clearance through the injection hole 2.

Also in the case where the section of the framework 1 has a regular square shape or similar and both the right and left side surfaces S of the framework 1 meet at right angles with the bottom surface $S_1$ of the upper concrete $C_1$, the similar problem has occurred according to circumstances.

That is to say, the bottom surface $S_1$ of the upper concrete $C_1$ is inclined for easy escaping of bleeding water and air bubbles, as shown in FIG. 12, so that, if the framework 1 is installed obliquely relative to the inclination of the bottom surface $S_1$ or the bottom surface $S_1$ is inclined in right and left directions due to the poor assembling accuracy of the framework for the upper concrete, as shown in FIG. 15, both the right and left side surfaces S of the framework 1 do not become vertical planes but have an inclination even though they meet at right angles with the bottom surface $S_1$.

Accordingly, in these cases, when the surface $S_2$ of the lower concrete $C_2$ is settled, the settlement of a portion positioned above one side surface S of the framework 1 (a portion designated by a mark (a) in FIG. 15) is hindered, whereby the similar problem to the above described one occurs on one side of the injection hole.

The present invention has been achieved in view of the above described knowledge. Thus, it is a main object of the present invention to improve the continuity of an injection hole and a clearance in construction joints and completely carry out the injection of injection materials up to the depths by a remarkably simple construction in which merely a sectional shape of a framework for forming an injection hole is devised.

It is another object of the present invention to make angles formed between both side surfaces of the framework and a bottom surface of an upper concrete obtuse whichever surface of the framework for forming an injection hole is, stuck to the bottom surface o the upper concrete, thereby improving the continuity of the injection hole and the clearance in construction joints and getting along without paying attention so as not to misinstall the framework for forming an injection hole.

It is a further object of the present invention to make the formation of the injection hole by taking off the framework and the direct injection of injection materials onto a back side of a steel frame possible even though the framework for forming an injection hole is arranged under the condition that it is bent so as to go around the steel frame and the like.

It is a still further object of the present invention to curtail a quantity of solvents used for taking off said framework in spite of the use of the framework for forming an injection hole having a sufficient size.

In order to achieve the above described objects, the present invention takes the following measures. That is to say, the present invention provides a method of treating construction joints in the top-down construction method, in which a lower concrete is constructed below an upper concrete under the condition that a framework for forming an injection hole in a bottom surface of said upper concrete, after said lower concrete is set, said framework being removed to form an injection hole, and an injection material, such as cement paste containing expansive additive and non-shrinkage additive, being injected through said injection hole, characterized by that said framework for forming an injection hole is brought into close contact with or close to the bottom surface of said upper concrete at upper sides of both right and left side surfaces thereof and has a longitudinal sectional shape so that an angle formed between said both right and left side surfaces and the bottom surface of said concrete may be obtuse.

The longitudinal sectional shape of the framework for forming an injection hole meeting the above described conditions includes an inverted trapezoidal shape, a semicircular shape and similar one but it is effective to select the regular triangular longitudinal sectional shape of the framework for forming an injection hole by the reason which will be mentioned later.

In addition, the framework for forming an injection hole may be removed by pulling off said framework but it is effective to dissolve with solvents for the reason which will be mentioned later.

In this case, the framework for forming an injection hole may be solid or hollow but the latter is desirable for the reason which will be mentioned later.

With the above described construction, since the upper edges of both the right and left side surfaces of the framework for forming an injection hole is brought into close contact with or close to the bottom surface of the upper concrete, a part of the lower concrete does not go around onto the upper surface side of the framework for forming an injection hole when the lower concrete is constructed below the upper concrete.

Since the angle formed between both the right and left side surfaces of the framework for forming an injection hole and the bottom surface of the upper concrete is obtuse, the natural settlement of the concrete portions brought into contact with both the right and left side surfaces of the framework by the gravity is not hindered by both right and left side surfaces when the surface of the lower concrete is settled with the rise of a bleeding water.

Accordingly, the continuity of the injection hole formed by removing said framework for forming an injection hole and the clearance in the construction joints can be secured.

BRIEF DESCRIPTION OF THE DRAWINGS

FIGS. 13 to 15 are diagrams of points at issue in the conventional methods.

BRIEF DESCRIPTION OF THE PREFERRED EMBODIMENTS

The preferred embodiments of the present invention will be described below with reference to FIGS. 1 to 9 and FIGS. 12(A) to (D) used for the explanation of the conventional method.

Figure 1:
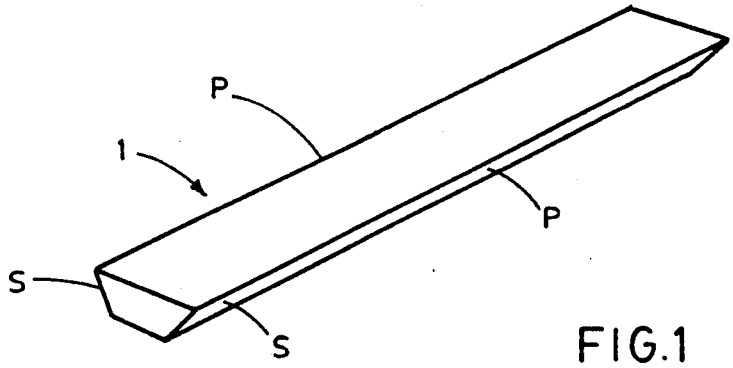
FIG. 1 is a perspective view showing one example of a framework for forming an injection hole used in the present invention.
Figure 2A:
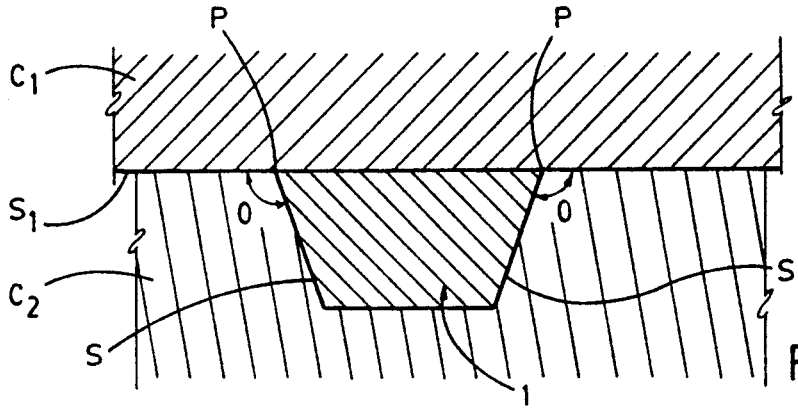
FIGS. 2(A) to (C) are longitudinal sectional views showing the principal parts to explain an injection treatment method of construction joints by the use of said framework.
Figure 12A:
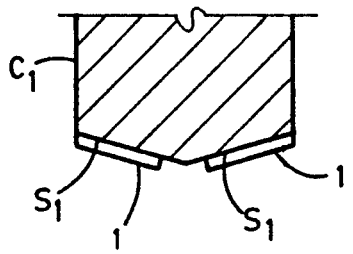
FIG. 12A PRIOR ART
FIGS. 12(A) to (D) are longitudinal sectional views used for an explanation of another conventional method and the present invention.

As shown in FIG. 1, the framework 1 for forming an injection hole formed of synthetic resins, such as foam styrene, and having the appointed longitudinal sectional shape (for example, inverse trapezoidal shape) is stuck to the bottom surface $S_1$ of the upper concrete $C_1$ by the use of adhesives, adhesive tapes and the like, as shown in FIG. 12(A). Under this condition, as shown in FIG. 2(A), the upper sides of both the right and left side surfaces S of said framework 1 are brought into close contact with or close to said bottom surface $S_1$. In addition, as shown in FIG. 2(A), the obtuse angle $\theta$ is formed between said both right and left side surfaces S and said bottom surface $S_1$.

Figure 12B:
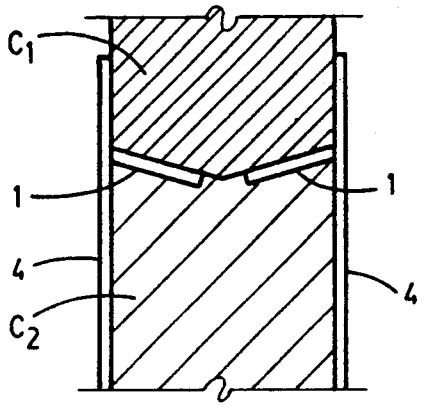
FIG. 12B PRIOR ART

Subsequently, as shown in FIG. 12(B), a suitable framework 4 is constructed below the upper concrete $C_1$ and the lower concrete $C_2$ is cast.

Figure 2B:
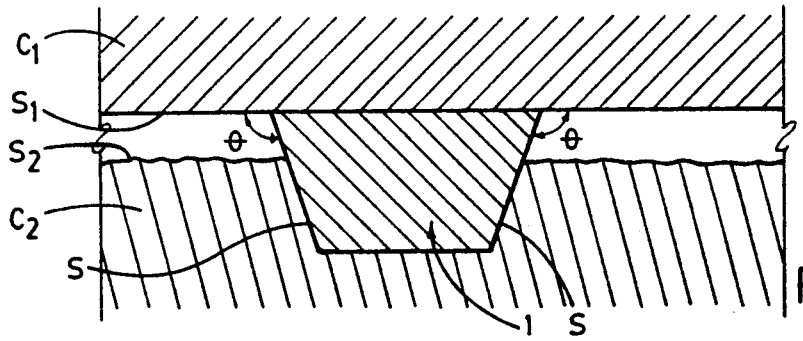
Figure 2C:
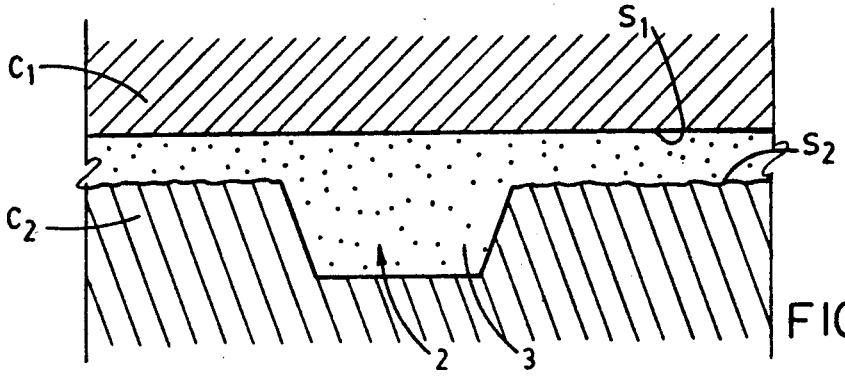

The surface of the lower concrete $C_2$ is gradually settled with the rise of bleeding water but the obtuse angle $\theta$ is formed between both the right and left side surfaces S of the framework 1 for forming an injection hole and the bottom surface $S_1$ of the upper concrete $C_1$, so that both the right and left side surfaces S do not hinder the settlement of the surface of the lower concrete $C_2$, as shown in FIG. 2(B), and also the concrete portions brought into contact with both the right and left side surfaces S are almost uniformly settled.

Figure 12C:
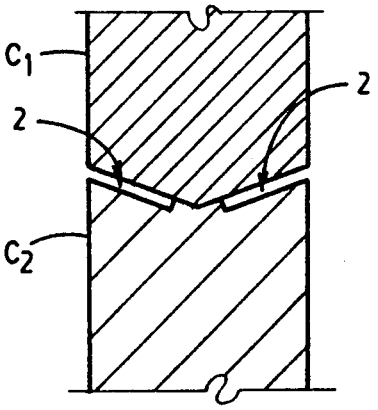
FIG. 12C PRIOR ART

After the lower concrete $C_2$ is set, said framework 4 is dismembered and the solvents, such as thinner, are poured into the position of the framework 1 for forming an injection hole to dissolve said framework 1, whereby forming the injection hole 2, as shown in FIG. 12(C). As above described, also the concrete portions brought into contact with both the right and left side surfaces S are almost uniformly settled, so that the injection hole 2 can be surely connected with the clearance of the construction joint.

Figure 12D:
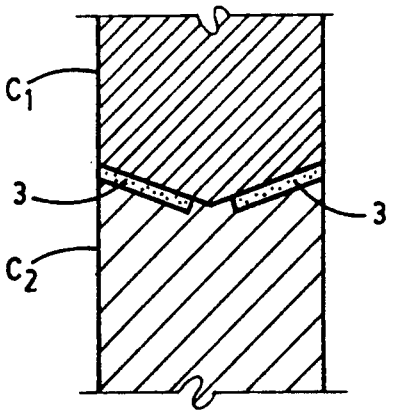

Then, the injection material 3 is injected through said injection hole 2, as shown in FIG. 12(D). In this case, as above described, the superior continuity is achieved between the injection hole 2 and the clearance, so that the injection material 3 can be surely injected into the clearances on both sides through the injection hole 2.

In addition, dissolved leavings of the framework 1 for forming an injection hole are almost negligible in quantity, so that the injection material 3 may be injected immediately after the dissolution of the framework 1 but water may be poured into the injection hole 2 prior to the injection of the injection material 3 to wash the injection hole 2 and the clearance. Resinous injection materials, such as epoxy resins and isocyanate resins, and cement pastes containing expansive additive and non-shrinkage additive can be used as said injection material 3. Any synthetic resin soluble in the solvents without leaving harmful substances can be used as a material of the framework 1 for forming an injection hole formed of synthetic resins. A typical example is foam styrene. Aromatic solvents, such as thinner, toluene, benzene and xylene, halogenated hydrocarbons, such as ethylene dichloride and trichloroethylene, ethers, such as butyl acetate, and the like, that is, various kinds of substance, can be used as the solvents.

Figure 3:
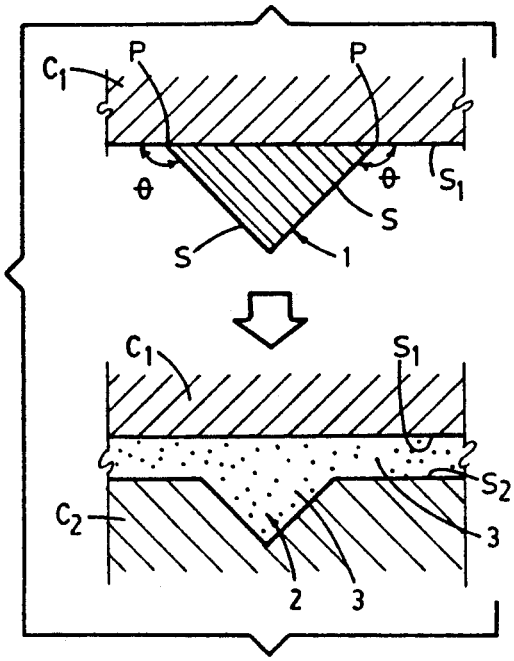
FIGS. 3 to 7 are longitudinal sectional views showing the principal parts to explain other preferred embodiments of the present invention.
Figure 4:
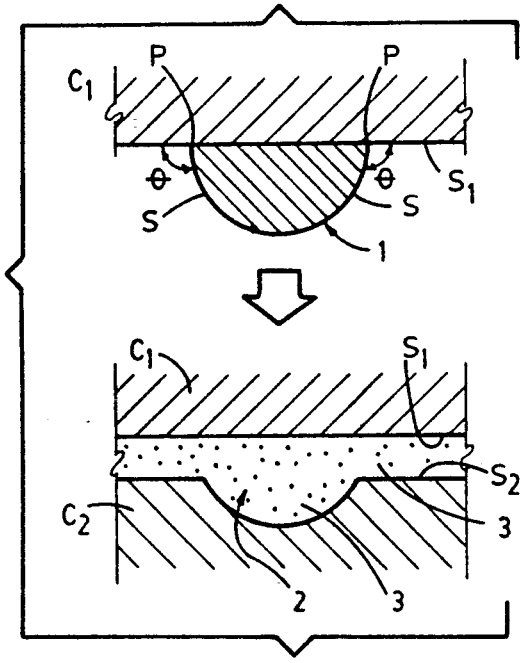
Figure 5:
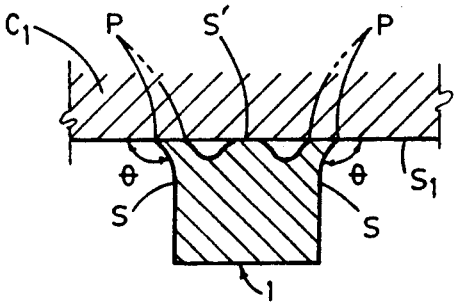

The longitudinal sectional shape of the framework 1 for forming an injection hole may be triangular, as shown in FIG. 3, or may be semicircular or similar, as shown in FIG. 4. In addition, as shown in FIG. 5, the vicinity of the upper sides (p) of both the right and left side surfaces S may be pleated so as to be elastically deformed, whereby the pleated portion is continued to be brought into close contact with the bottom surface $S_1$ by the elastic stability thereof under the condition that the upper surface S' of the framework 1 is stuck to the bottom surface $S_1$ of the upper concrete $C_1$.

Figure 6:
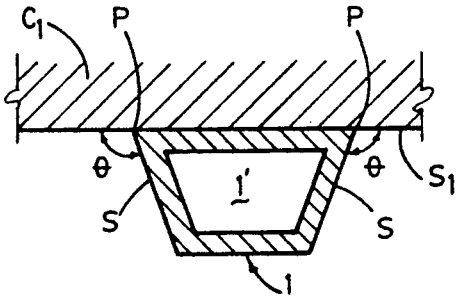

FIG. 6 shows another preferred embodiment of the present invention. This preferred embodiment is characterized by the quantity of the solvents used being reduced with securing the thickness necessary for the formation of said injection hole 2 by forming the framework 1 for forming an injection hole in a hollow shape (a shape having a hollow portion 1').

Figure 7:
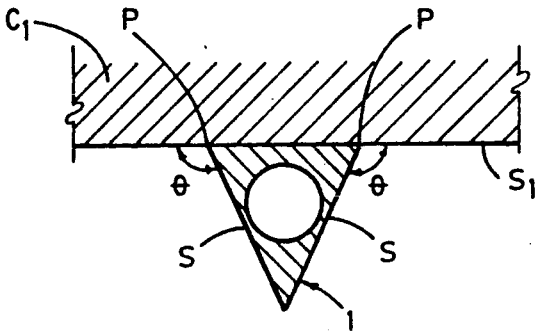

FIG. 7 shows a further preferred embodiment. This preferred embodiment is characterized by the longitudinal sectional shape of the framework 1 for forming an injection hole being regular triangular so that the above described condition may be satisfied whichever surface is stuck to the bottom surface $S_1$. The hollow portion 1' intends to reduce the quantity of the solvents used in the same manner as in the preferred embodiment shown in FIG. 6.

Figure 8:
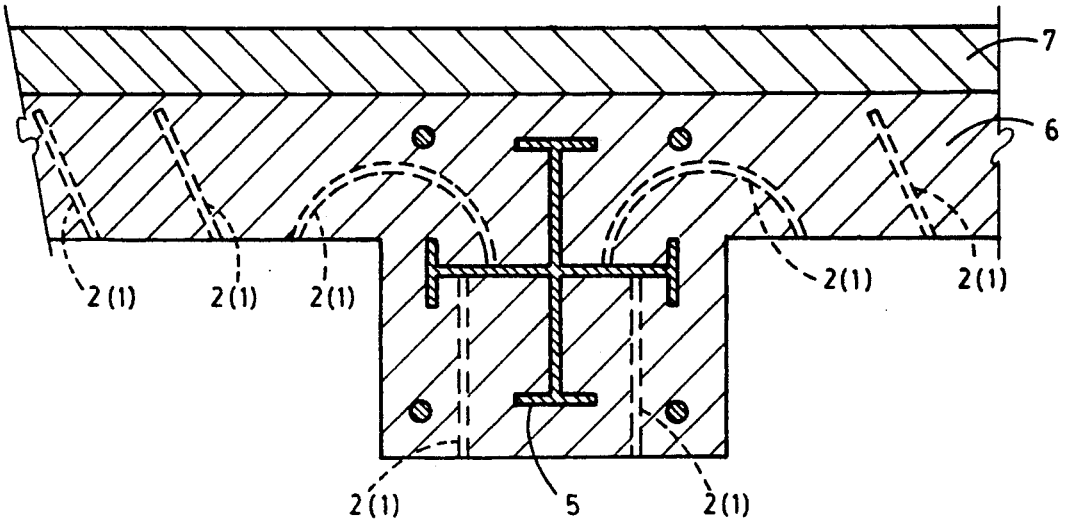
FIG. 8 is a cross-sectional plan view showing the principal parts int he basement of buildings to explain an example of the arrangement of the framework for forming an injection hole.

In the above described respective preferred embodiments, the framework 1 for forming an injection hole is removed by dissolving said framework 1 with the solvents, so that it is not required to arrange the framework 1 linearly. Accordingly, as shown in for example FIG. 8, the bent injection hole 2 can be formed to directly inject the injection material on the back side of the steel frame 5. In addition, in the case where the injection hole 2 is formed in the construction joint of an underground outer wall 6, the inclined arrangement of the respective frames 1 in the same direction is effective for uniformly injecting the injection material into the clearance of the construction joint, as shown in FIG. 8. Referring to FIG. 8, reference numeral 7 designates a barrier-wall.

In addition, after the lower concrete $C_2$ is set, the framework 1 for forming an injection hole may be pulled out to form the injection hole 2. For example, the framework 1 is formed of materials, to which concrete is not stuck, or the surface of the framework 1 is coated with grease, that is, the framework 1 is subjected to a suitable measure for preventing concrete from sticking thereto, and after the lower concrete is set to some extent, in short, at a point of time when it is still early to dismember the framework 4 for use in the lower concrete but the molding is possible because no big force is applied to the construction joints from above, the framework 1 can be pulled out from a hole which is previously formed in said framework 4 to form said injection hole 2.

Figure 9:
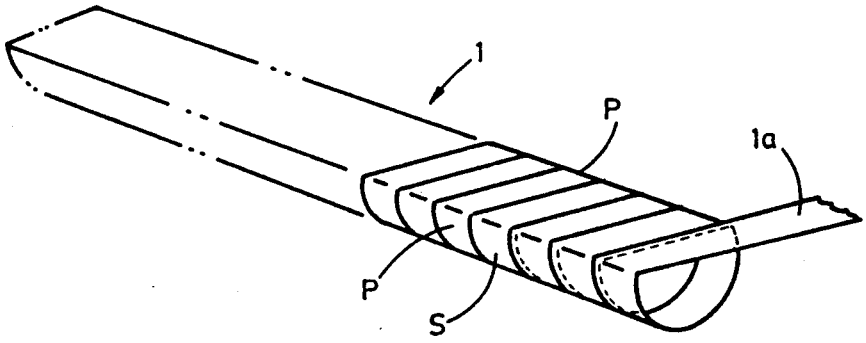
FIG. 9 is a perspective view showing an extractable framework for forming an injection hole according to another preferred embodiment of the present invention.
Figure 10A:
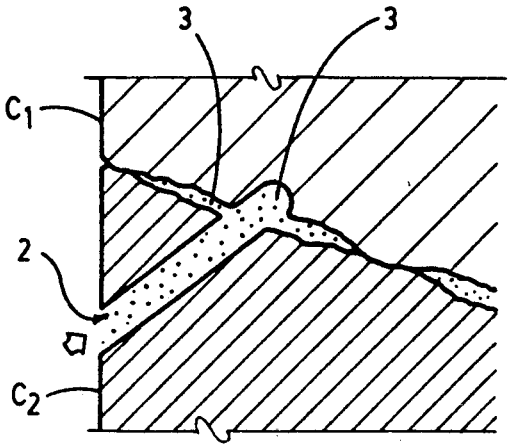
FIGS. 10(A), (B), and 11 are longitudinal sectional views showing the principal parts to explain the conventional methods.
Figure 10B:
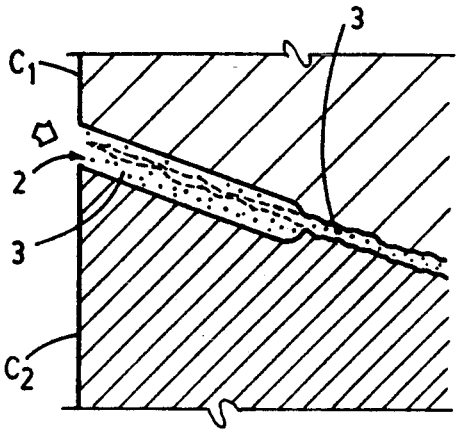
Figure 11:
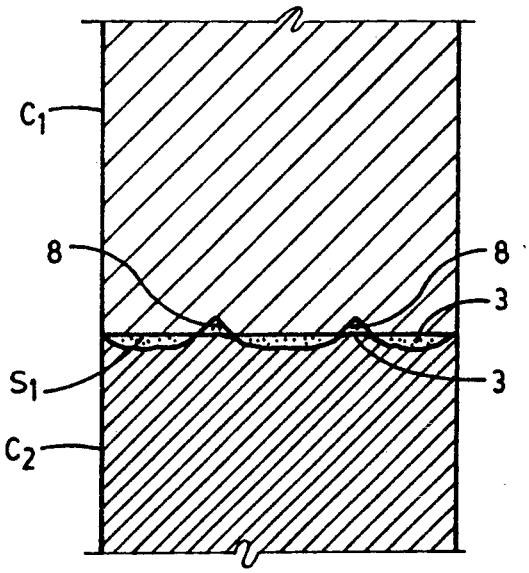

In addition, if the framework 1 for forming an injection hole comprising a resinous tape 1*a* spirally wound in an appointed sectional shape is used, as shown in FIG. 9, the overlap of the resinous tape 1*a* is reduced and the diameter of the framework 1 is reduced by pulling one end of the framework 1 in the axial direction so that it can be pulled out by a slight force even after the lower concrete is completely set. Although it is not shown, if the framework 1 for forming an injection hole is formed of rubber, its diameter is reduced by pulling one end thereof, so that it can be easily pulled out even though it has a sectional shape as shown in FIGS. 2 to 7.

According to the present invention, since the upper sides of both the right and left side surfaces of the framework for forming an injection hole are brought into close contact with or close to the bottom surface of the upper concrete, a part of the lower concrete does not go around up to the upper surface side of the framework for forming an injection hole when a lower concrete is constructed below an upper concrete, and, since the angles formed between both the right and left side surfaces of the framework for forming an injection hole and the bottom surface of the upper concrete are obtuse, the settlement of the concrete portions brought into contact with both the right and left side surfaces of the framework is not hindered by said right and left side surfaces when the surface of the lower concrete is settled with the rise of bleeding water.

Accordingly, the continuity between the injection hole, which is formed by removing said framework for forming an injection hole, and the clearance of construction joint can be secured to completely inject the injection material.

In one method, the longitudinal sectional shape of the framework for forming an injection hole is a regular triangle, so that the angles formed between both the right and left side surfaces of the framework and the bottom surface of the upper concrete are obtuse whichever surface of said framework is stuck to the bottom surface of the upper concrete. Accordingly, it is not required to pay attention so that the framework may not be misinstalled and thus the efficiency and reliability of the installation of the framework are improved.

Since the framework for forming an injection hole is removed by dissolving it with solvents, it is not required to give the extractable shape to the framework. Accordingly, for example the framework can be arranged so as to go round the steel frame to directly inject the injection material up to the back side of the steel frame.

Since the framework for forming an injection hole is hollow, the quantity of the solvents used can be reduced and thus the method is economical even though the sufficient size is given to said framework so that the injection hole easy in injecting operation may be formed.

What is claimed is:

1. A method of sealing a concrete joint formed between a pair of concrete castings constructed in a top down construction method, the sealing method forming an injection hole feeding into the concrete joint such that clearances are filled up between the two concrete castings by injecting sealing material into the hole and joint, the injection hole being formed beneath a first preexisting concrete casting, the sealing method comprising the steps of:

attaching an upper surface of a removable impression forming member to a bottom surface of the first preexisting concrete casting that is to interface with a subsequently poured lower second concrete casting so that respective opposite side edges of the removable member extend towards each other and form obtuse angles with the bottom surface of the first preexisting concrete casting;

pouring the second concrete casting around the removable member and underneath the first preexisting concrete casting, the second concrete casting having a top surface interfacing with the bottom surface of the first preexisting concrete casting and forming the joint between the first and second concrete castings adjacent to the removable member as the second casting sets and settles, such that the obtuse angles formed between the opposite side edges of the removable member and the bottom surface of the first preexisting concrete casting prevent adherence of the top surface of the poured second concrete casting to the upper surface of the removable member during the settling of the poured second concrete casting thus providing for improved continuity of access between the joint and the injection hole to be formed;

allowing the poured second concrete casting to set and settle thereby forming the joint between the first and second concrete castings while preventing the adherence of the top surface of the poured second concrete casting to the upper surface of the removable member;

removing the removable member from between the two concrete castings to thereby form the injection hole for feeding into the joint, wherein the continuity of access between the joint and the injection hole is ensured by the prevention of the adherence between the top surface of the poured concrete casting and the upper surface of the removable member during the settling of the poured concrete casting; and injecting the sealing material into the injection hole for feeding into the joint to fill the clearances between the two concrete castings and thus seal the concrete joint.

2. The method of claim 1 wherein a structural frame member is cast in the second concrete casting and a second removable member is bent to permit injection access to a surface of the structural frame member.

3. The method of claim 1 wherein the removable member has a cross-sectional trapezoidal configuration and a base of the trapezoidal configuration is attached to the first concrete casting to form the obtuse angle.

4. The method of claim 1 wherein the removable member is formed of styrene foam and the removing step includes applying a liquid aromatic solvent to dissolve the removable member.

5. The method of claim 1 further including the step of resiliently attaching the removable member so that a sinusoidal configuration is provided adjacent the bottom surface of the first concrete casting.

6. The method of claim 1 wherein the removing step includes injecting a dissolving solvent down an interior passageway formed in the removable member to dissolve the removable member.

7. The method of claim 6 wherein the removable member is formed of a synthetic resin and the step of dissolving includes applying an aromatic solvent to the interior passageway.

* * * * *